US010792223B1

(12) United States Patent
Lamaster et al.

(10) Patent No.: US 10,792,223 B1
(45) Date of Patent: Oct. 6, 2020

(54) PILL DISPENSING APPARATUS FOR USE WITH BLISTER PILL PACKAGES

(71) Applicant: Nathaniel Paul Lamaster, Tyler, TX (US)

(72) Inventors: Nathaniel Paul Lamaster, Tyler, TX (US); Sandy Margot, Bedford, NH (US); Spencer Trafton, Nashua, NH (US)

(73) Assignee: Nathaniel Paul Lamaster, Tyler, TX (US)

( * ) Notice: Subject to any disclaimer, the term of this patent is extended or adjusted under 35 U.S.C. 154(b) by 0 days.

(21) Appl. No.: 16/375,569

(22) Filed: Apr. 4, 2019

Related U.S. Application Data

(60) Provisional application No. 62/652,406, filed on Apr. 4, 2018.

(51) Int. Cl.
*A61J 7/00* (2006.01)
*A61J 1/03* (2006.01)
*B65B 69/00* (2006.01)

(52) U.S. Cl.
CPC ..... *A61J 7/0076* (2013.01); *A61J 1/035* (2013.01); *B65B 69/0041* (2013.01); *B65B 69/0058* (2013.01)

(58) Field of Classification Search
CPC . A61J 1/03; A61J 1/035; A61J 7/0076; B65B 69/0041; B65B 69/0058; B65D 83/0463
See application file for complete search history.

(56) References Cited

U.S. PATENT DOCUMENTS 3,915,393 A * 10/1975 Elkins ..... A61J 7/0007 241/168
4,694,996 A * 9/1987 Siegel ..... A61J 3/00 100/268
5,431,283 A * 7/1995 Weinstein ..... B65D 5/42 206/469
7,252,208 B1 * 8/2007 Alvino ..... B65D 83/0463 221/28
7,562,790 B2 * 7/2009 Wheeler ..... A61J 7/0007 206/538

(Continued)

FOREIGN PATENT DOCUMENTS

WO WO2016196392 A1 12/2016

*Primary Examiner* — Gene O Crawford
*Assistant Examiner* — Kelvin L Randall, Jr.
(74) *Attorney, Agent, or Firm* — Plager Schack LLP; Mark H. Plager; Eric Liou

(57) ABSTRACT

A pill dispensing apparatus for use to dispense a pill from a blister package includes a base assembly having an interior cavity formed by an upper plate coupled to a lower housing, the upper plate having an opening and partially extending over the lower housing to form a spout in the lower housing, an arm pivotably mounted to the base assembly and having a post protruding downward toward the base assembly, and a spring coupled to the arm and upper plate of the base assembly. The apparatus is designed to receive the blister package between the base assembly and arm. Pivotal movement of the arm toward the base assembly allows the post of the arm to push the pill in the blister package through the opening in the upper plate of the base assembly. This allows the pill to travel in the base assembly's internal cavity and out the spout.

6 Claims, 5 Drawing Sheets

(56) References Cited

U.S. PATENT DOCUMENTS

| | | | | |
|---|---|---|---|---|
| 7,971,749 | B2 * | 7/2011 | Drought | B65B 69/0058 221/194 |
| 10,123,943 | B2 | 11/2018 | Patil et al. | |
| 2006/0138014 | A1 * | 6/2006 | Drought | A61J 1/035 206/528 |
| 2010/0193536 | A1 * | 8/2010 | Benktzon | A61J 1/035 221/1 |

* cited by examiner

PILL DISPENSING APPARATUS FOR USE WITH BLISTER PILL PACKAGES

RELATED APPLICATION

The application claims priority to provisional patent application U.S. Ser. No. 62/652,406 filed on Apr. 4, 2018, the entire contents of which is herein incorporated by reference.

BACKGROUND

The embodiments herein relate generally to blister pill packages. More specifically, embodiments of the invention are directed to a pill dispensing apparatus for use with blister pill packages.

Blister pill packages are commonly used to store medication pills. Opening blister pill packaging is difficult to do efficiently and sanitarily. Pushing each pill in the blister package manually or by use of a tool often causes one or more pills to fall on the floor, become crushed, or lost. Scissors and other tools used to cut the blister pill packaging are made from materials that can transfer bacteria to the pills or improve the likelihood of cross-contamination from different medications.

Several devices for cutting, extracting and/or splitting medication pills from packs exist as disclosed in U.S. Pat. Nos. 10,123,943 and 7,562,790. These devices generally comprise upper and lower members adjusted relative to each other to engage the pill or medication pack. However, these devices are limited because they comprise complex components and/or are difficult to use. In particular, there is a need for these devices to comprise an improved spring mechanism that resets the upper and lower members to the neutral position more easily and efficiently to engage the next pill or medication pack.

As such, there is a need in the industry for a pill dispensing apparatus for use with blister pill packages that addresses the limitations of the prior art, which enables users to dispense pills from blister pill packages with enhanced efficiency and cleanliness.

SUMMARY

In certain embodiments, a pill dispensing apparatus for use to dispense a pill from a blister package with enhanced efficiency is provided. The pill dispensing apparatus comprises a base assembly comprising an interior cavity formed by an upper plate coupled to a lower housing, the upper plate partially extending over the lower housing to form a spout in the lower housing connected to the interior cavity of the base assembly, the upper plate comprising an opening continuously connected to the interior cavity of the base assembly, an arm pivotably mounted to the base assembly and comprising a lower member with a post protruding downward toward the base assembly and aligned with the opening in the upper plate of the base assembly, and a spring comprising a first end coupled to the arm and a second end coupled to the upper plate of the base assembly, wherein the apparatus is configured to receive the blister package between the base assembly and arm with the pill in the blister package aligned with the post of the arm and opening in the upper plate of the base assembly, wherein pivotal movement of the arm toward the base assembly to a closed position allows the post of the arm to push the pill in the blister package through the opening in the upper plate of the base assembly, thereby allowing the pill to travel in the internal cavity of the base assembly for a disposal out of the spout.

In an alternative embodiment, the pill dispensing apparatus comprises a base assembly having an interior cavity formed by an upper plate coupled to a lower housing, the upper plate partially extending over the lower housing to form a spout in the lower housing connected to the interior cavity of the base assembly, the upper plate comprising an opening continuously connected to the interior cavity of the base assembly, an arm pivotably mounted to the base assembly and comprising a first post protruding downward toward the base assembly and aligned with the opening in the upper plate of the base assembly and a second post, and a spring comprising a first end configured to contact the second post and a second end coupled to the upper plate of the base assembly.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
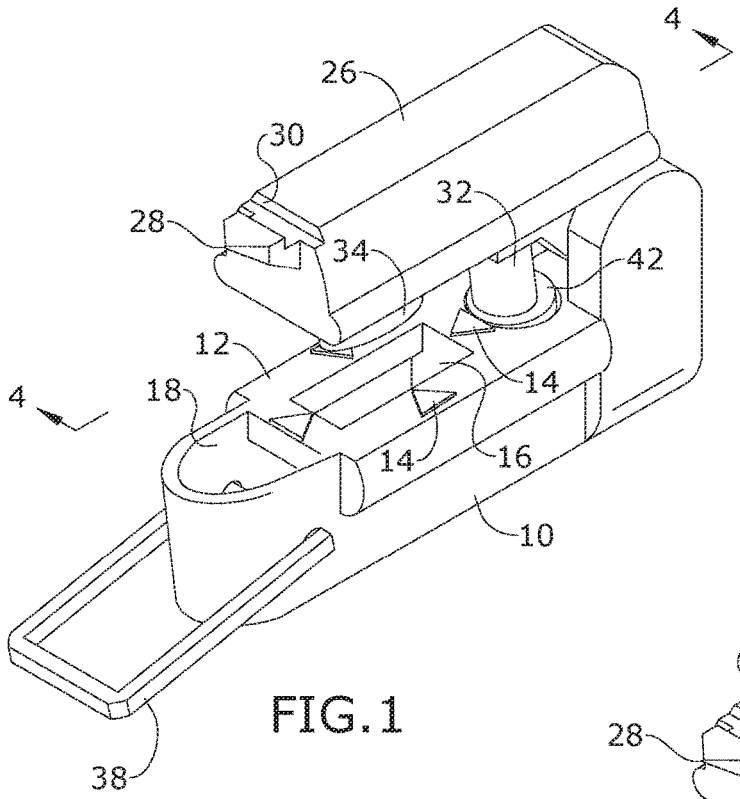
FIG. 1 depicts a perspective view of certain embodiments of the pill dispensing apparatus.
Figure 2:
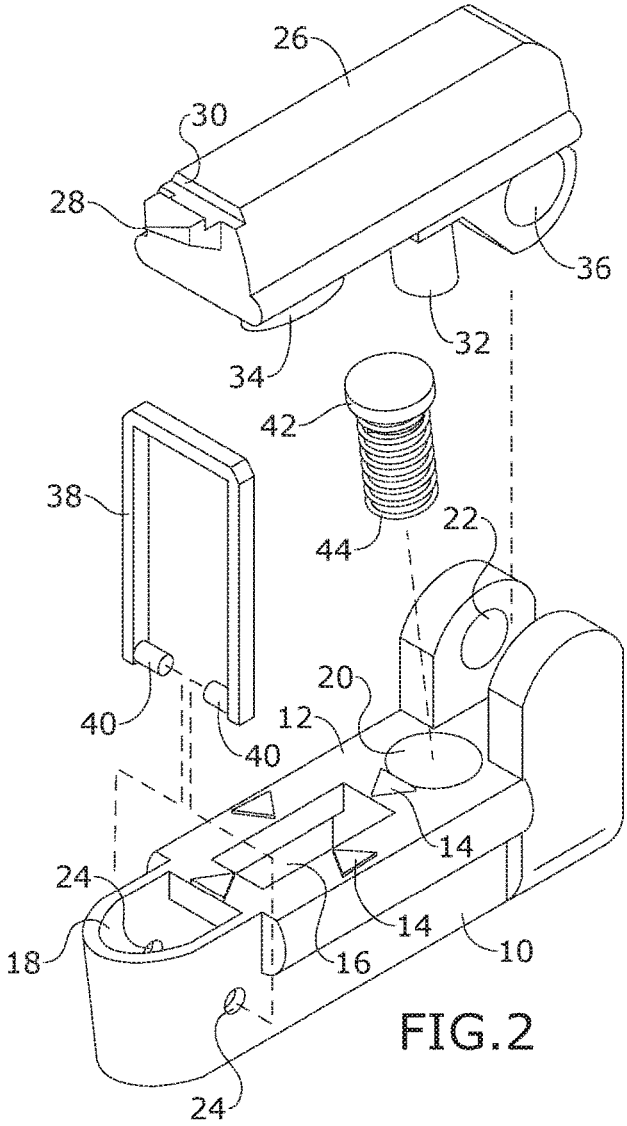
FIG. 2 depicts an exploded view of certain embodiments of the pill dispensing apparatus.
Figure 3:
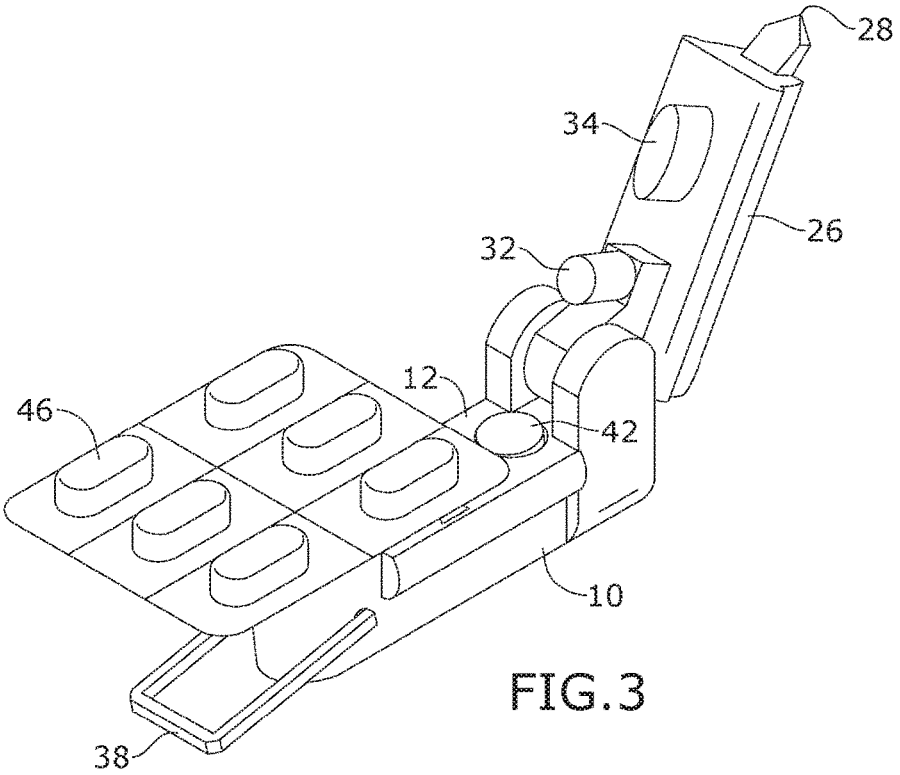
FIG. 3 depicts a perspective view of certain embodiments of the pill dispensing apparatus shown in use with blister pill package 46.

In certain embodiments as depicted in FIGS. 1-3, the pill dispensing apparatus is configured to dispense pills 48 from blister pill packages 46 with enhanced efficiency and cleanliness. In certain embodiments, the pill dispensing apparatus generally comprises a base assembly comprising lower housing 10 and upper plate 12, arm 26, handle 38 and spring 44.

The pill dispensing apparatus is preferably made from acrylonitrile butadiene styrene (ABS) plastic. However, the components of the pill dispensing apparatus can be made from other materials or combination of materials including, but not limited to, other plastics, stainless steel, other metals, rubber, and the like.

In certain embodiments, upper plate 12 is coupled to lower housing 10 in the base assembly to form an interior cavity. Upper plate 12 partially extends over lower housing 10 to form spout 18. In one embodiment, upper plate 12 comprises drop-through opening 16, which is connected to the interior cavity of the base assembly. This creates a pathway for pill 48 to travel from blister pill package 46 through drop-through opening 16 in upper plate 12, the interior cavity of the base assembly, and out spout 18 for a disposal.

In one embodiment, upper plate 12 comprises spring slot 20 configured to receive spring 44 and a plurality of guide arrows 14 disposed on upper plate 12 around the perimeter of drop-through opening 16. Spring 44 is preferably made from stainless steel, another metal or material in the field. In one embodiment, cap 42 is coupled to the top of spring 44 as depicted in FIG. 2. In one embodiment, spring 44 is coupled to the interior of spring slot 20 in the base assembly by a mechanical fastener (not shown) such as a screw. Guide arrows 14 in upper plate 12 help a user to align pill 48 in blister pill package 46 directly above drop-through opening 16 during the operation of the pill dispensing apparatus.

In certain embodiments, arm 26 is pivotably mounted to lower housing 10 of the base assembly. More specifically, arm 26 comprises a pair of hinge nubs 36 that engage with hinge nub slots 22 in lower housing 10. In this configuration, arm 26 is configured to pivotably adjust to the desired position relative to lower housing 10 of the base assembly as will be described in more detail in the following disclosure.

In certain embodiments, arm 26 comprises a top surface with blade 28 and notch 30, and a bottom surface with package post 34 and spring post 32. Blade 28 extends away from the front of arm 26 and is configured to cut any surface such as the back of blister pill package 46 to aid in the removal of pill 48 stored therein. Blade 28 is preferably made from stainless steel, another metal or material.

Figure 4:
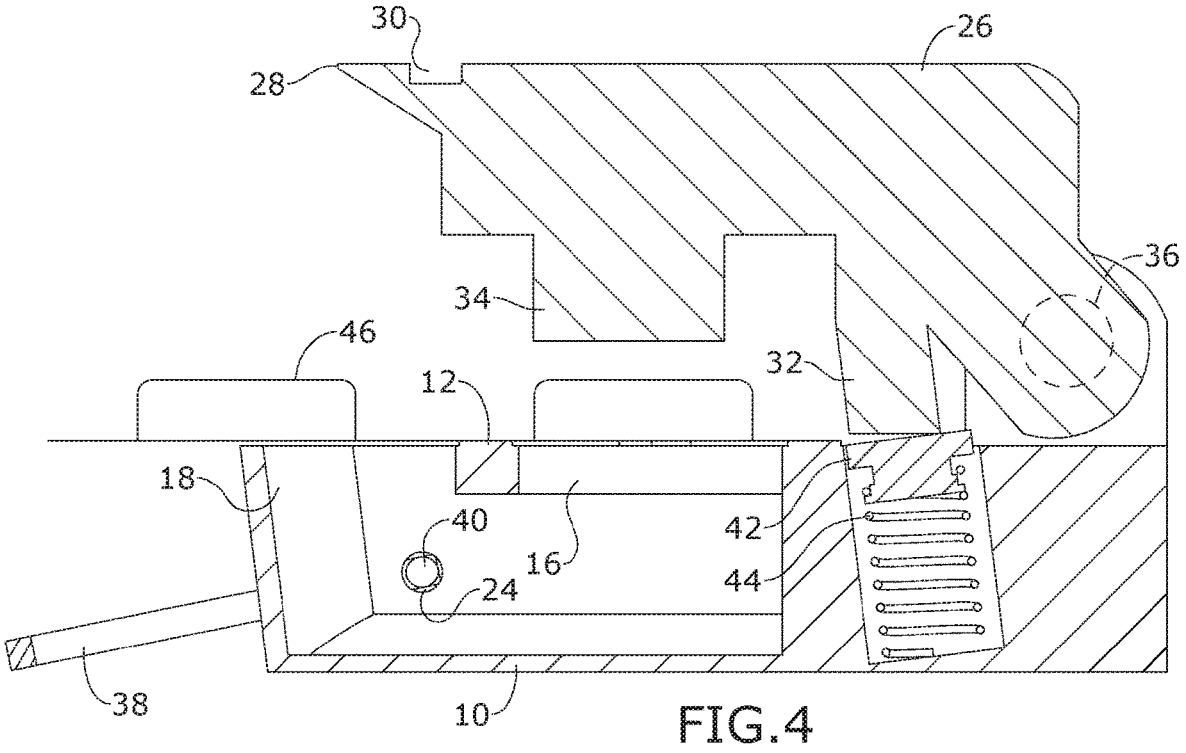
FIG. 4 depicts a section view of certain embodiments of the pill dispensing apparatus, taken along line 4-4 in FIG. 1.
Figure 5:
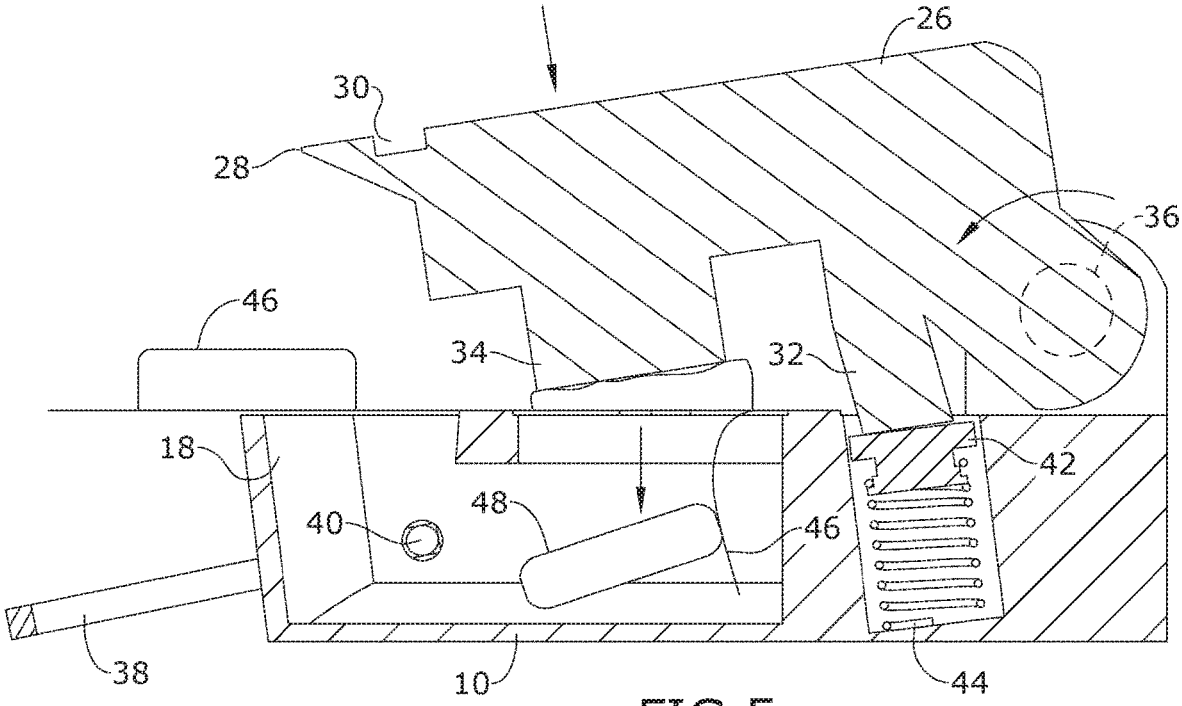
FIG. 5 depicts a section view of certain embodiments of the pill dispensing apparatus illustrating the depression of arm 26 to dispense pill 48 from blister pill package 46.
Figure 6:
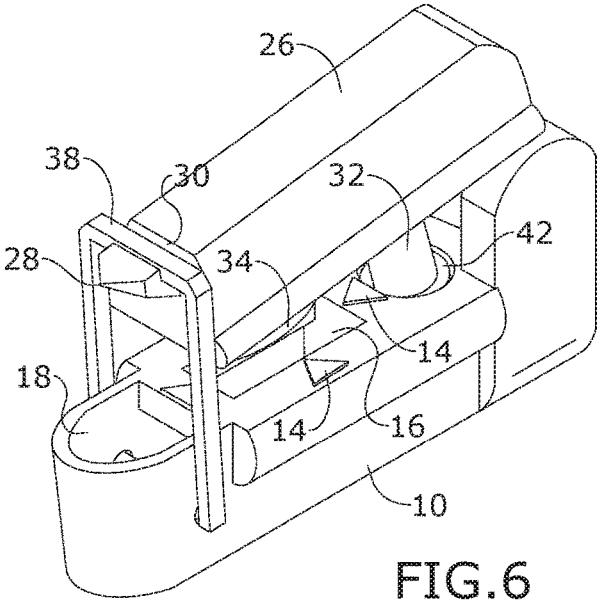
FIG. 6 depicts a perspective view of certain embodiments of the pill dispensing apparatus in a stored position.

In certain embodiments, arm 26 is configured to pivotably adjust relative to upper plate 12 of the base assembly to an open position as depicted in FIGS. 1 and 3-4 or a closed position as depicted in FIG. 5. In one embodiment as depicted in FIG. 2, lower housing 10 of the base assembly comprises a pair of post slots 24 that is configured to receive posts 40 of handle 38. This allows handle 38 to pivotably adjust relative to lower housing 10. Handle 38 is configured to pivotably adjust away from the base assembly as depicted in FIGS. 1, 3-5 or around arm 26 to engage with notch 30 to secure arm 26 and the base assembly in the stored position as depicted in FIG. 6.

In operation, blade 28 of the pill dispensing apparatus can be used to cut the back of blister pill package 46 where pill 48 is located. As depicted in FIG. 3, arm 26 is pivotably adjusted relative to the base assembly to the open position to allow pill 48 in blister pill package 46 to be disposed directly above drop-through opening 16 in upper plate 12. As depicted in FIG. 5, arm 26 is pivotably adjusted to the closed position by applying a downward force on arm 26 when above upper plate 12 in the base assembly. In this position, pill 48 is aligned with package post 34 in arm 26 and drop-through opening 16 in upper plate 12. Spring post 32 of arm 26 is also aligned with spring cap 42 on spring 44.

The downward force applied to arm 26 allows package post 34 to push pill 48 in blister pill package 46 through drop-through opening 16 in upper plate 12 to the interior cavity of the base assembly. With blister pill package 46 removed, the pill dispensing apparatus is tilted to allow pill 48 to travel through the interior cavity of the base assembly and out spout 18. It shall be appreciated that the release of arm 26 allows spring 44 to apply a counterforce on spring post 32 to automatically return arm 26 to the open position as depicted in FIGS. 1 and 4.

It shall be appreciated that the pill dispensing apparatus may comprise various modifications to the components. FIGS. 7-10 depict an alternate pill dispensing apparatus that comprises components generally similar to the pill dispensing apparatus previously described.

In certain embodiments of the invention, the alternate pill dispensing apparatus generally comprises a base assembly comprising lower housing 50 and upper plate 60, an arm assembly comprising lower arm member 88 and upper arm housing 76, handle 96, spring 72 and spring cover 74.

The alternate pill dispensing apparatus is preferably made from acrylonitrile butadiene styrene (ABS) plastic. However, the components of the alternate pill dispensing apparatus can be made from other materials or combination of materials including, but not limited to, other plastics, stainless steel, other metals, rubber, and the like.

Figure 8:
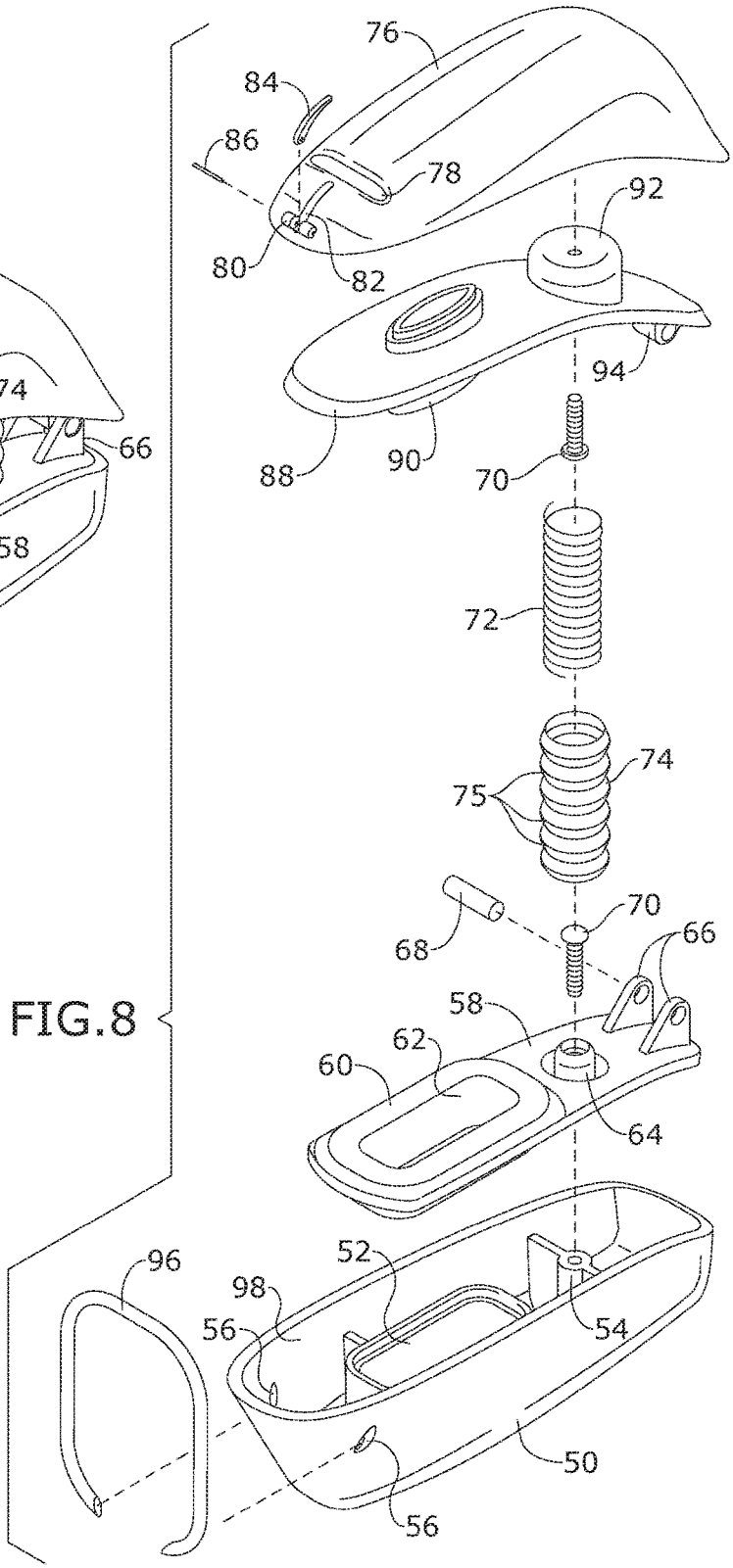
FIG. 8 depicts an exploded view of the alternative embodiment of the pill dispensing apparatus.
Figure 9:
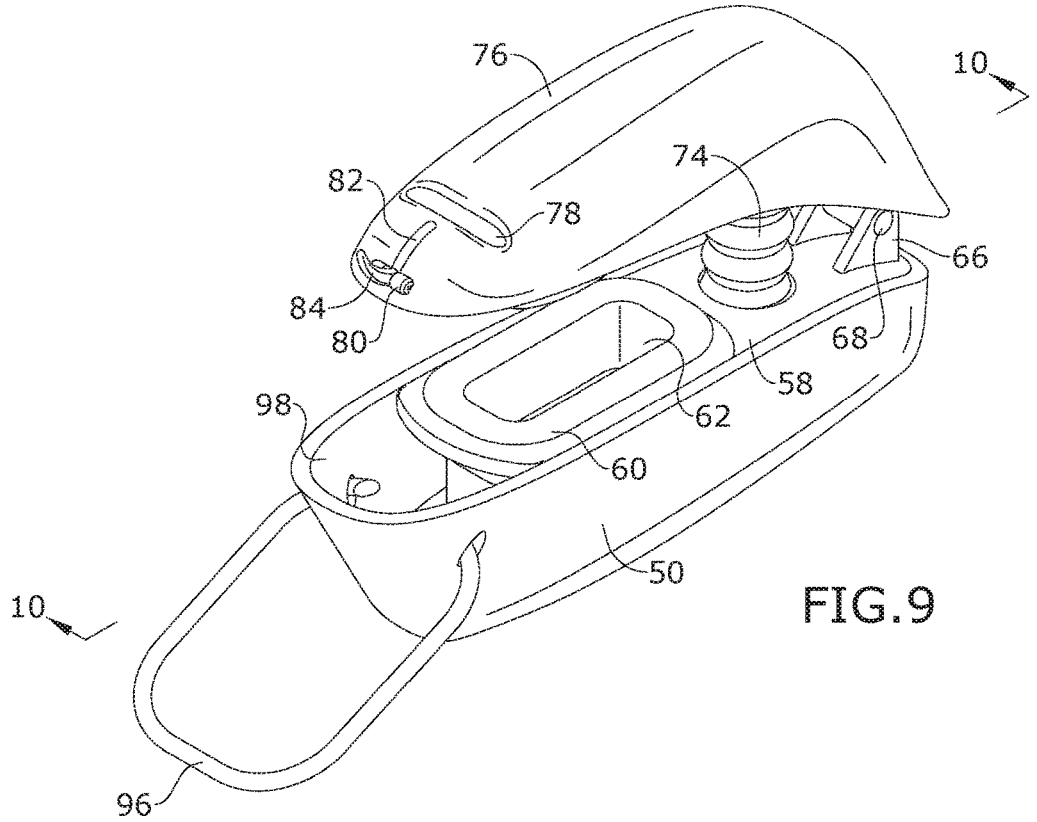
FIG. 9 depicts a perspective view of the alternative embodiment of the pill dispensing apparatus in the open position.
Figure 10:
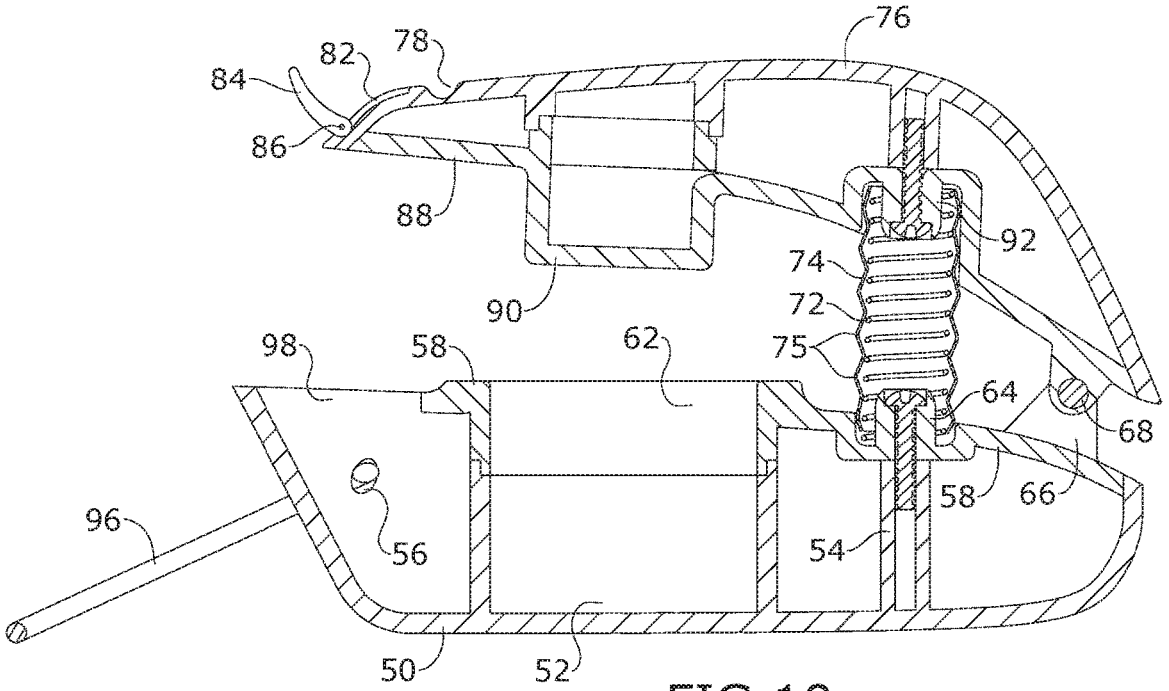
FIG. 10 depicts a section view of the alternative embodiment of the pill dispensing apparatus, taken along line 10-10 in FIG. 9.

In certain embodiments as depicted in FIGS. 8-10, upper plate 60 is coupled to lower housing 50 in the base assembly to form an interior cavity. Upper plate 60 partially extends over lower housing 50 to form spout 98. In one embodiment, upper plate 60 comprises drop-through opening 62, which is connected to the interior cavity of the base assembly. This creates a pathway for pill 48 to travel from blister pill package 46 through drop-through opening 62 in upper plate 60, the interior cavity of the base assembly, and out spout 98 for a disposal.

In one embodiment, upper plate 60 comprises hinge arms 66 and spring post 64 in rear portion 58 of upper plate 60. Spring post 64 is configured to receive spring 72 and spring cover 74. Spring 72 is preferably made from stainless steel, another metal or material. Spring cover 74 is a tubular member that is disposed around spring 72 and is preferably made from a low to medium density polyethylene or other similar-type material.

Spring cover 74 comprises a plurality of protrusions 75 disposed throughout the tubular member. Protrusions 75 help spring cover 74 to compress and extend as will be described in more detail later. Spring cover 74 is beneficial because it serves as a protective layer that prevents moisture from sources such as liquid gel pills from contacting spring 72, screws 70 and other internal components of the alternate pill dispensing apparatus.

In certain embodiments, lower housing 50 comprises base post 54, which is aligned with spring post 64 in upper plate 60. In one embodiment, lower housing 50 comprises pill catch slot 52 and a pair of openings 56. Pill catch slot 52 is positioned directly beneath drop-through opening 62 to help guide pill 48 through the interior cavity of the base assembly and out spout 98. The pair of openings 56 in lower housing 50 of the base assembly is configured to receive handle 96. This allows handle 96 to pivotably adjust relative to lower housing 50.

In certain embodiments as depicted in FIGS. 8-10, the arm assembly of the alternate pill dispensing apparatus is pivotably mounted to upper plate 60 in the base assembly. More specifically, lower arm member 88 of the arm assembly comprises hinge knuckle 94, which is aligned with hinge arms 66 in upper plate 60 of the base assembly. Pin 68 secures hinge knuckle 94 to hinge arms 66 to permit pivotal movement of the arm assembly relative to the base assembly.

In certain embodiments, lower arm member 88 of the arm assembly comprises package post 90 on the bottom surface and arm post 92. Upper arm housing 76 is coupled to lower arm member 88 as depicted in FIGS. 8 and 10. In one embodiment, upper arm housing 76 comprises a top surface with notch 78 and blade 84.

Figure 7:
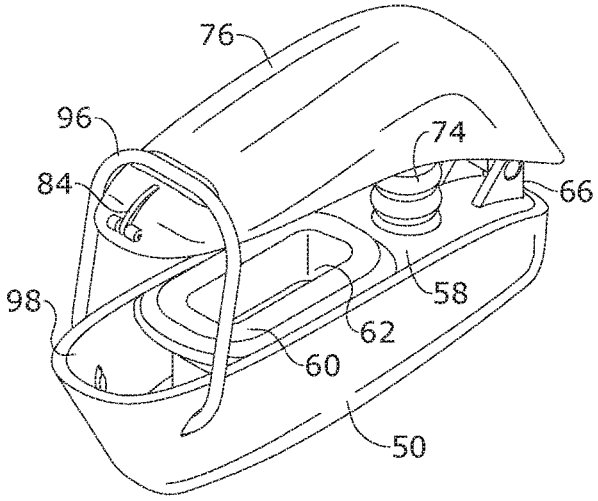
FIG. 7 depicts a perspective view of an alternative embodiment of the pill dispensing apparatus in a stored position.

As depicted in FIG. 7, notch 78 is configured to engage with handle 96 to secure the arm assembly and base assembly together in the stored position. Handle 96 is pivotably adjusted away from the base assembly as depicted in FIGS. 9-10 to place the alternate pill dispensing apparatus in an operational configuration.

In certain embodiments as depicted in FIGS. 7-10, blade 84 is pivotably mounted to upper arm housing 76 of the arm assembly. More specifically, upper arm housing 76 comprises blade hinge knuckles 80 and blade slot 82. Blade 84 is secured to blade hinge knuckles 80 by pin 86. This connection allows blade 84 to pivotably adjust relative to upper arm housing 76 to an extended position as depicted in FIGS. 9-10 or a retracted position within blade slot 82 in upper arm housing 76 as depicted in FIG. 7.

In the assembled configuration as depicted in FIGS. 9-10, the arm assembly pivotably adjusts relative to upper plate 60 of the base assembly to the open position as depicted in FIGS. 9-10 to receive blister pill package 46 or closed position to permit the arm assembly to push pill 48 out of blister pill package 46. In the assembled configuration, the top end of spring 72 is coupled to the interior of arm post 92 of lower arm member 88 by first screw 70. The bottom end of spring 72 is coupled to spring post 64 of upper plate 60 in the base assembly by second screw 70. Second screw 70 extends through spring post 64 and base post 54. Spring cover 74 is disposed around spring 72 and comprises opposing ends secured within arm post 92 in the arm assembly and upper plate 60 in the base assembly.

In operation, the alternate pill dispensing apparatus is operated in substantially the same manner as the pill dispensing apparatus previously described in other embodiments. Blade 84 of the alternate pill dispensing apparatus can be used to cut the back of blister pill package 46 where pill 48 is located. The arm assembly is pivotably adjusted relative to the base assembly to the open position as depicted in FIGS. 9-10 to allow pill 48 in blister pill package 46 to be disposed directly above drop-through opening 62 in upper plate 60. The arm assembly is pivotably adjusted to the closed position by applying a downward force on upper arm housing 76 when pill 48 in blister pill package 46 is aligned with package post 90 in the arm assembly and drop-through opening 62 in upper plate 60. This downward force compresses spring 72 and spring cover 74 between lower arm member 88 of the arm assembly and upper plate 60 of the base assembly.

The downward force applied to the arm assembly allows package post 90 to push pill 48 in blister pill package 46 through drop-through opening 62 in upper plate 60 to the interior cavity of the base assembly. With blister pill package 46 removed, the alternate pill dispensing apparatus is tilted to allow pill 48 to travel through the interior cavity of the base assembly and out spout 98. It shall be appreciated that the release of the arm assembly allows spring 72 and spring cover 74 to apply a counterforce on lower arm member 88 to automatically return the arm assembly to the open position. This places the alternate pill dispensing apparatus in the ready position to receive another blister pill package 46.

It shall be appreciated that the pill dispensing apparatuses described in embodiments of the invention are beneficial for use to open different types of pill packages (small, oblong, gel, or large) efficiently and can be used sanitarily in a hospital, home setting or other location. It shall be appreciated that the components of the pill dispensing apparatuses described in several embodiments herein may comprise any alternative known materials in the field and be of any color, size and/or dimensions. It shall be appreciated that the components of the pill dispensing apparatuses described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A pill dispensing apparatus for use to dispense a pill from a blister package with enhanced efficiency, the pill dispensing apparatus comprising:

a base assembly comprising an interior cavity formed by an upper plate coupled to a lower housing, the upper plate partially extending over the lower housing to form a spout in the lower housing connected to the interior cavity of the base assembly, the upper plate comprising an opening continuously connected to the interior cavity of the base assembly;

an arm pivotably mounted to the base assembly and comprising a lower member with a post protruding downward toward the base assembly and aligned with the opening in the upper plate of the base assembly;

a spring comprising a first end coupled to the arm and a second end coupled to the upper plate of the base assembly; and a tubular cover disposed around the spring and in contact with the lower member of the arm and upper plate of the base assembly, the tubular cover comprising a plurality of protrusions configured to permit the tubular cover to compress and extend in response to movement of the arm relative to the base assembly;

wherein the apparatus is configured to receive the blister package between the base assembly and arm with the pill in the blister package aligned with the post of the arm and opening in the upper plate of the base assembly, wherein pivotal movement of the arm toward the base assembly to a closed position allows the post of the arm to push the pill in the blister package through the opening in the upper plate of the base assembly, thereby allowing the pill to travel in the internal cavity of the base assembly for a disposal out of the spout.

2. The pill dispensing apparatus of claim 1, wherein the spring and tubular cover apply a counterforce to the arm in the closed position to permit pivotable movement of the arm away from the base assembly to an open position.

3. The pill dispensing apparatus of claim 2, further comprising an upper housing coupled to the lower member of the arm, the upper housing comprising a blade pivotably mounted to a top surface of the upper housing.

4. The pill dispensing apparatus of claim 3, further comprising a notch disposed on the top surface of the upper housing.

5. The pill dispensing apparatus of claim 4, further comprising a handle pivotably mounted to the lower housing of the base assembly, the handle configured to pivotably adjust to engage with the notch in the upper housing of the arm to secure the arm and base assembly in a stored position.

6. The pill dispensing apparatus of claim 5, further comprising a first mechanical fastener disposed within the spring and configured to secure the upper plate of the base assembly to the lower housing of the base assembly, and a second mechanical fastener disposed within the spring and configured to secure the lower member of the arm to the upper housing of the arm.

* * * * *